United States Patent [19]

Sato et al.

[11] Patent Number: 4,773,135

[45] Date of Patent: Sep. 27, 1988

[54] METHOD FOR MANUFACTURING ARTIFICIAL FURS

[75] Inventors: Kenji Sato; Seiichi Yamagata; Masaski Sakai, all of Otsu, Japan

[73] Assignee: Toray Industries, Inc., Tokyo, Japan

[21] Appl. No.: 863,591

[22] Filed: May 15, 1986

Related U.S. Application Data

[63] Continuation of Ser. No. 395,010, Jul. 1, 1982, abandoned.

[30] Foreign Application Priority Data

| | | | |
|---|---|---|---|
| Nov. 28, 1980 | [JP] | Japan | 55-166526 |
| Apr. 8, 1981 | [JP] | Japan | 56-51655 |
| May 26, 1981 | [JP] | Japan | 56-79537 |

[51] Int. Cl.[4] ..... D04B 21/04; D06C 13/10; D05C 17/02; D03D 27/10

[52] U.S. Cl. ..... 28/160; 26/14; 26/2 R; 66/194; 139/397

[58] Field of Search ..... 28/160, 159, 162, 168; 26/13, 14, 2 R, 8; 66/194; 139/397

[56] References Cited

U.S. PATENT DOCUMENTS

| | | | |
|---|---|---|---|
| 1,760,464 | 5/1930 | Achtmeyer | 28/160 X |
| 2,737,702 | 3/1956 | Schmidt et al. | 28/160 X |
| 3,013,325 | 12/1961 | McNally et al. | 28/160 |
| 4,415,611 | 11/1983 | Yamagata et al. | 28/160 X |

FOREIGN PATENT DOCUMENTS

| | | | |
|---|---|---|---|
| 55-148245 | 11/1980 | Japan | 66/194 |
| 228 | of 1894 | United Kingdom | 28/160 |
| 793699 | 4/1958 | United Kingdom | 28/160 |

*Primary Examiner*—Robert R. Mackey
*Attorney, Agent, or Firm*—Austin R. Miller

[57] ABSTRACT

An improved method for manufacturing an artificial fur from an intermediate pile cloth such as a double velvet weave fabric, a knitted pile fabric provided with two ground constructions and a connecting pile connecting these two ground constructions, and an intermediate pile cloth provided with looped pile projected upward from a ground construction fabric or knitted fabric or non-woven fabric. In the method of this invention, the continuity of the pile yarns of the intermediate pile cloth is broken by sliding separation, so as not to break at least a partial number of fibrous material which will become guard hair of the artificial fur.

48 Claims, 11 Drawing Sheets

METHOD FOR MANUFACTURING ARTIFICIAL FURS

RELATED APPLICATION

This is a continuation of our U.S. application Ser. No. 395,010 filed July 1, 1982 now abandoned. Further, claims directed to the looped pile embodiment of this invention, the apparatus and the yarn are located in copending divisional application Ser. Nos. 924,041; 924,256 and 923,973, filed Oct. 28, 1986.

FIELD OF THE INVENTION

The present invention relates to an improved method for manufacturing artificial furs.

DESCRIPTION OF THE PRIOR ART

High quality genuine furs, such as mink, fox, etc., are genuine furs which are almost impossible to artificially produce, because of their excellent hand, excellent luster and special structural features, mainly due to the hair structure.

Accordingly, genuine furs still maintain their excellent position in the fur trade as high quality furs, because such genuine furs are recognized as a status symbol and can be used as an extremely high class raw material for making garments of high fashion. Therefore, many technical proposals have been put forth and research has been conducted for the purpose of creating artificial furs having excellent qualities similar to those of high quality genuine furs.

Some new technologies such as disclosed in U.S. Pat. No. 2,737,702 have been disclosed as being comparatively advanced in the field of producing artificial fur. In the technology disclosed by U.S. Pat. No. 2,737,702, a method is proposed for producing an artificial fur by means of a knitting machine from a sliver composed of staple fibers of a first group, which form a layer of guard hair of the fur, and staple fibers of a second group, which form a layer of underfur of the artificial fur. In this method, the use of a particular kind of fibers is proposed for the first group of fibers, wherein each fiber is provided with two tapered end portions. It can be recognized that the quality of this artificial fur is similar to genuine fur in that the free end of each guard hair is tapered. Since the free end portions of the guard hair in the genuine fur are generally tapered, the great contribution to the technology in the field of producing the artificial furs taught by the above mentioned U.S. patent must be recognized.

However, in the artificial fur disclosed by the above mentioned U.S. patent, a problem still remains which must be solved in order to create a good quality artificial fur. This problem is mainly due to the characteristic feature of the pile fibers which do not satisfy the qualities required in the combination of the guard hair with the underfur. That is, the quality of flutter of the guard hair is insufficient as compared with that of genuine fur. In addition to the above mentioned inferiority of this feature of artificial fur, the hand of this artificial fur is coarse. Specifically, the hand of the guard hair is rather coarse, so that a fur-like soft and elegant hand is not achieved with this artificial fur. It has been found that the above mentioned problems are mainly due to a structural feature of the guard hair. The root portion of the guard hair fibers, which is locked in the ground construction of the artificial fur, is not thin.

Co-inventors of the present invention have invented a very unique method for making an artificial fur which has an excellent hand, excellent luster and special structural features, mainly due to the guard hair being like that of genuine furs, and the method of manufacturing which is disclosed in U.S. Pat. No. 4,415,611. This artificial fur has the following characteristic features regarding the construction thereof. That is, this artificial fur comprises a ground construction and numerous units of pile fibers projecting upward from the ground construction, and each unit of pile fibers is provided with a yarn-like bundle at a root portion. At least a main part of the above mentioned root portion is firmly locked in the ground construction and the fibers of each unit are opened up above the root portion, the pile fibers are made from fibrous materials and are provided with varied lengths thereof in a range from almost zero to a length almost the maximum fiber length.

To produce the above mentioned unique artificial fur the following method was invented and disclosed in U.S. Pat. No. 4,415,611. This method comprises the following three steps: a first step of making a pile cloth consisting of a ground construction and a plurality of yarn-like pile units projected upward from the ground construction;

a second step of raising the pile to remove those fibers not firmly held in the ground construction while opening those fibers firmly held by the ground construction; and a third step of finishing the raised pile cloth product.

However, it has been determined that the artificial fur produced by the method of U.S. Pat. No. 4,415,611 has serious problems regarding the guard hair as well as the quantity of waste fibrous material made during the second step of the method which is a significant factor in manufacturing costs. Further, the manufacture of the pile cloth is often accompanied by cutting the fibrous material of the guard hair contained in the pile. Therefore, it is preferable to produce the intermediate pile cloth with pile having a pile length not shorter than the maximum length of the fibrous material forming the guard hair. Therefore, the greater the pile length of the intermediate pile cloth, the greater the number of free fibrous materials which are not firmly held by the ground construction. In other words, there is a great quantity of waste fibrous material created in the second step (raising operation) of the manufacturing method of U.S. Pat. No. 4,415,611. Such an increase in waste fibrous material by the removal of free fibrous material cannot be neglected in practice.

In this specification, the term "pile cloth" means (1) a pile fabric provided with a woven or knitted ground construction with or without a backing substance and a plurality of pile fibers projecting upward from the ground construction or (2) a pile cloth provided with a non-woven ground construction with or without a backing substance and a plurality of pile fibers projecting upward from the ground construction.

SUMMARY OF THE INVENTION

An object of the present invention is to provide an improved method for manufacturing artificial fur having characteristics similar to high quality genuine furs in structure, appearance, and hand.

This object of the present invention can be attained by the following basic idea for creating pile fibers projecting upward from the ground construction, the manufacture of the pile cloth for the artificial fur from an intermediate pile cloth such as double velvet weave construction, or such as a tufted pile cloth utilizing a non-woven cloth as the ground construction thereof. The continuity of each pile of the intermediate cloth is broken without breaking or cutting at least some of the fibrous material forming the guard hair of the artificial fur and contained in the pile. It is essential that the breaking of continuity of each pile be carried out so as to satisfy the above mentioned conditions. Therefore, it may be understood that, the method for manufacturing the artificial fur according to the present invention is characterized by the application of the processing based upon the above mentioned basic idea.

The apparatus to carry out the method according to the present invention, embodies specific ideas for the member for breaking the continuity of each pile projected from the ground construction of the intermediate pile cloth.

DETAILED DESCRIPTION OF THE INVENTION

For ease of understanding the present invention, the principle of the present invention is first explained in detail, in reference to the drawings.

The method for manufacturing artificial fur according to the present invention is characterized by the basic idea of breaking the continuity of each pile contained in the intermediate pile cloth such as a fabric having a double velvet weave construction or a tufted pile cloth utilizing a woven or non-woven cloth.

In the present invention, the following principles for carrying out the process of breaking the continuity of each pile contained in the intermediate cloth is introduced in reference to the following basic idea which is hereinafter explained in detail.

Figure 1:
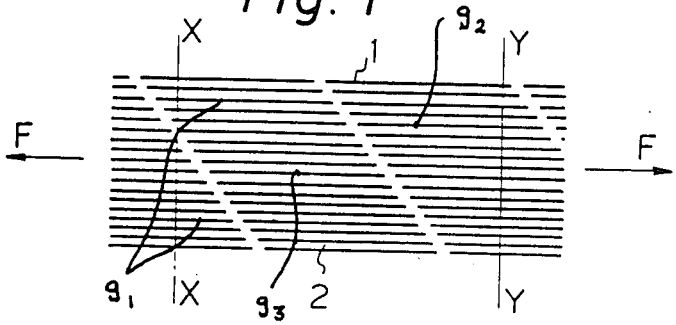
FIG. 1 is a schematic side view of an ideal model of a bundle of fibers wherein the fibers are arranged uniformly.
Figure 2:
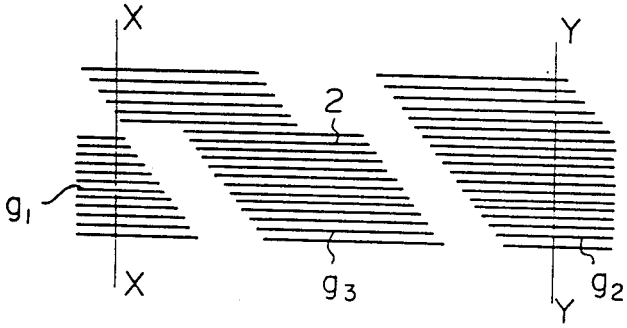
FIG. 2 is a schematic side view of the bundle of fibers shown in FIG. 1 when separating them into two portions along the lengthwise direction thereof.

FIG. 1 indicates a typical model of the fiber arrangement of a theoretical bundle 1 of fibers 2, compacted in a yarn form by a means not shown. Fibers 2 are uniformly arranged parallel to the longitudinal axis of the bundle of fibers, and this bundle 1 is held by a pair of grips (not shown) at the XX and YY positions so that the distance between the two gripped positions XX and YY is larger than the staple length of the component fibers 2. The bundle 1 is pulled apart by the grips along the longitudinal direction, therefore tension F along the longitudinal direction of the bundle 1 is created. Under such condition, as shown in FIG. 2, three groups of fiber 2 are created. A first group $g_1$, wherein fibers 2 are held by the grip represented by the line XX, the second group $g_2$ wherein fibers 2 are held by the grip represented by the line YY, and the third group $g_3$ wherein fibers 2 are free from either of the above mentioned grips are created. In other words, the above mentioned application of tension F to the bundle 1 of fibers 2, as shown in FIG. 2, breaks the continuity of the bundle 1.

As described in U.S. Pat. No. 4,415,611, it is known that an artificial fur can be made from an intermediate pile cloth such as a pile fabric having a construction of double velvet weave or a pile cloth provided with a plurality of looped piles projected upward from a non-woven ground construction.

When using the intermediate pile cloth having a construction of double velvet weave, each of the plurality of piles (hereinafter referred to as "connecting pile") connecting the two ground constructions must be separated into two parts such that one is held by one ground construction and the other is held by the other ground construction thereby creating two pile cloths. Now it is assumed that the yarn for the pile is composed of a plurality of fibers uniformly arranged in parallel to the longitudinal axis of a bundle before providing twist. To simplify the following explanation, the existence of twist is excluded from the present explanation.

Figure 3:
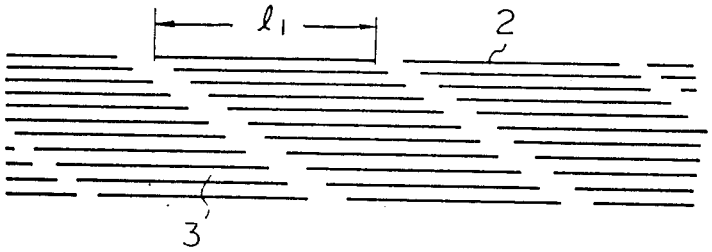
FIG. 3 is a schematic side view of a pile yarn for making an intermediate pile cloth indicating a theoretical fiber arrangement therein.
Figure 4A:
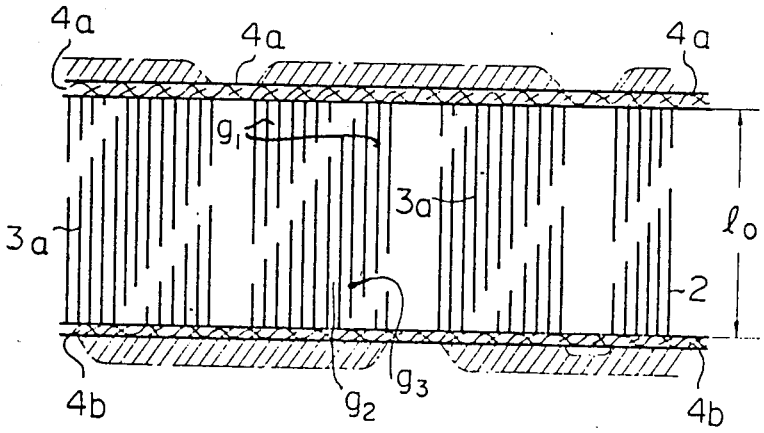
FIG. 4A is a schematic cross sectional view of a double velvet weave construction utilizing the yarn shown in FIG. 3.
Figure 4B:
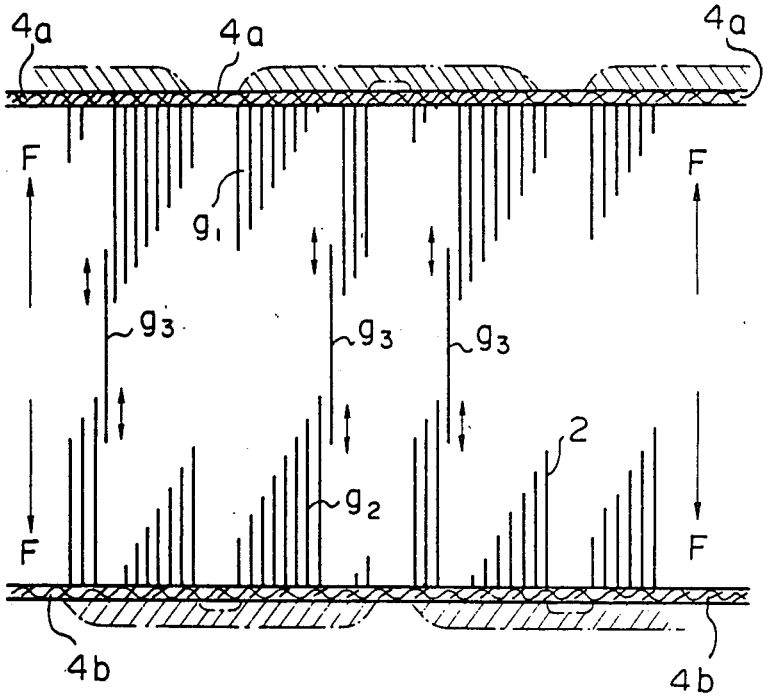
FIG. 4B is a schematic cross sectional view of the double velvet weave construction shown in FIG. 4A, in the preferable condition of breaking the continuity of the pile which connects the two ground constructions.
Figure 5:
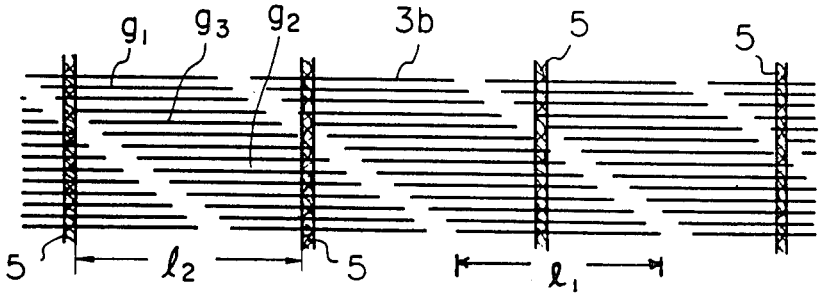
FIG. 5 is a schematic flat projection view of an intermediate pile cloth wherein a plurality of looped piles are projected upward from a ground construction.

The yarn 3 is represented as the bundle of the component fibers 2 in FIG. 3. In this drawing, each fiber 2 has an identical length $l_1$. If such material yarn 3 is used for the pile 3*a* of an intermediate pile cloth having double velvet weave construction provided with two ground constructions 4*a* and 4*b*, as shown in FIG. 4A, and the distance $l_0$ between the inside surfaces of the two ground constructions 4*a* and 4*b* is larger than the length $l_1$ of the fiber 2, the application of tension F to the pile 3*a* as in FIG. 1, a phenomenon similar to that shown in FIG. 2 is created. That is, as shown in FIG. 4B, the application of tension will separate the first group $g_1$ of fibers 2 held by ground construction 4*a* and the second group $g_2$ held by the ground construction 4*b* and will free the third group $g_3$ from both ground constructions 4*a* and 4*b*. When using intermediate pile provided with a plurality of looped piles projected upward from a woven, knitted or non-woven ground construction, each looped pile must be separated into two parts such that each part is held by the ground construction. In intermediate pile cloth, as shown in FIG. 5, the length $l_2$ of the looped pile 3*b* projected upward from the ground construction 5 is preferably longer than the fiber length $l_1$ of the fiber 2. The application of tension to pull apart the looped pile 3*b* made by the yarn 3 will create a phenomenon similar to that depicted in FIGS. 2 and 4B. It will separate the first group $g_1$ of the fibers 2 held by the ground construction 5 from the second group $g_2$ of the fibers 2 held by the ground construction 5 and will free the third group $g_3$ of fibers 2 not held by the ground construction 5.

The above mentioned phenomenon of separating the continuity of the pile 3*a* and 3*b* is hereinafter referred to as "sliding separation". The application of the sliding separation of the component fibers of the pile, particularly the fibers forming the guard hair of the artificial fur, is one of the most important factors in the method for manufacturing the artificial fur according to the present invention. Application of the above mentioned basic technical idea of "sliding separation" to break the continuity of each pile of the intermediate pile cloth significantly reduces the possibility of cutting the tips of the fibers forming the guard hair or possibility of creating large amounts of fibers like the third group $g_3$ so that it allows considerable improvement in the quality of the final product, artificial fur. It is one of the most important results of the application of the present invention.

There are three kinds of yarn for forming the pile of the intermediate pile cloth. The first yarn is a spun yarn with very low twist. This yarn consists of a first group of fibrous material which will form guard hair and a second group of fibrous material which will form underfur of the artificial fur produced by the method and apparatus according to the present invention. To create a yarn having a similar fiber arrangement to the theoretical bundle of fibers shown in FIG. 1, it is preferable to reduce the number of twists imparted to the yarn. Reduction of the twist number below a certain limit, however, so weakens the yarn that the operation of producing the intermediate pile cloth becomes practically impossible. To overcome this, one can use a third fibrous component having a length longer than a certain length, such as that of the first group of fibers and blend it with the other two groups of fibers so as to create a modified yarn for the pile. In this case, before applying the sliding separation process, it is necessary to break the continuity of the pile. For the third fibrous component one can use a fiber soluble in a certain chemical agent. The above mentioned two yarns are hereinafter referred to as first spun yarns.

The second yarn is a double yarn formed by a first component yarn and a second component yarn. The first component yarn is composed of a first group of fibrous material to form the guard hair and a second group of fibrous material to form fibers forming the underfur of the artificial fur produced by the method and apparatus according to the present invention. In this first component yarn, the abovementioned two fibrous materials are blended uniformly and are arranged parallel to the longitudinal axis thereof. To impart yarn strength, this first component yarn is twisted. The second component yarn is made of a third fibrous component. This second component yarn may be a thin multifilament yarn or a thin spun yarn made from fibers easily removable by chemical or physical treatment or from a normal material. In this case, it is very important to substantially eliminate the twist of the first component yarn when these two component yarns are twisted.

As was disclosed in U.S. Pat. No. 4,415,611 a multifilament yarn consisting of a plurality of individual filaments, each having an island-in-sea fiber construction can be used to form the first group of fibrous material which form the guard hair of the artificial fur produced by the method and apparatus according to the present invention. In this case, this multifilament yarn is twisted with another multifilament yarn to create a second group of fibrous material to form the underfur of artificial fur. It is preferable to use this yarn constructed with the second component yarn surrounding the first component yarn. It is preferable to remove the sea component of this island-in-sea fiber by a known chemical treatment before the sliding separation of the pile. This type of yarn is hereinafter referred to as a third yarn.

The basic idea is to utilize the phenomenon of sliding separation to break the continuity of the pile of the intermediate pile cloth in the present invention. Therefore, in all cases utilizing the above mentioned yarns to form pile in the intermediate pile cloth, it is essential to first change the condition of the yarn to the ideal constructions shown in FIG. 3 as much as possible. This enables smooth and effective sliding separation to break the continuity of the piles.

Figure 6A:
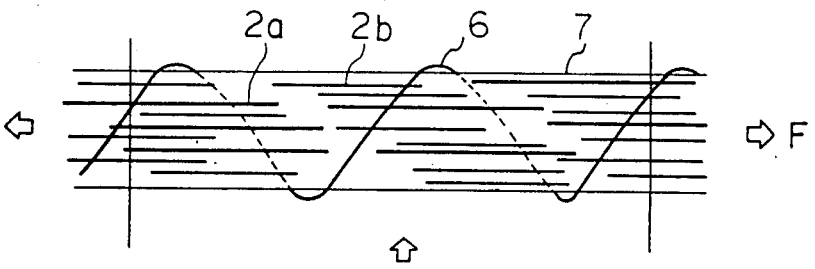
FIG. 6A is a schematic side view of a yarn consisting of three fibrous materials wherein the third spirally surrounds the core portion consisting of the other two, for producing a pile cloth.
Figure 6B:
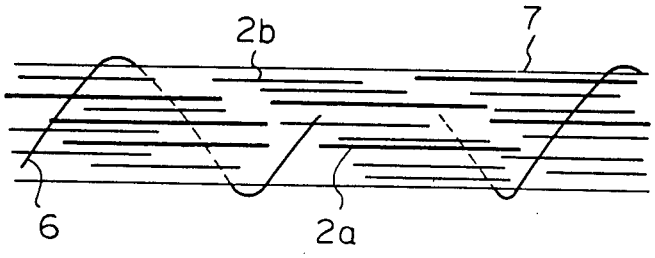
FIG. 6B is a schematic side view of the pile yarn shown in FIG. 6A which indicates the breaking of the continuity of the third fibrous material during the process for manufacturing artificial fur according to the present invention.

For ease of understanding, this technical idea is explained in more detail with reference to the embodiment shown in FIGS. 6A and 6B, which is an example utilizing the second yarn. Each pile 2 in the intermediate pile cloth is formed by a bundle of fibers consisting of a first group of fibrous material 2*a*, a second group of fibrous material 2*b*, and a third fibrous material 6 spirally surrounding the above-mentioned bundle of fibrous materials as shown in FIG. 6A. The first group of fibrous material 2*a* is longer and thicker than the second group of fibrous material 2*b* so that the first group 2*a* will form the guard hairs, and the second group 2*b* will form the underfur of the final artificial fur. These two groups of fibrous materials 2*a* and 2*b* are uniformly mixed in the yarn 7 and are arranged in parallel along the yarn axis. The intermediate pile cloth is constructed with a double-velvet weave construction, and yarn 7 forms a connecting pile between the two ground constructions when the double-velvet fabric is made. Therefore, the application of sliding separation necessitates first cutting, breaking or removing the third fibrous material 6 before creating the sliding separation. Research conducted by the present inventors has shown that the third fibrous material 6 can be easily cut by applying tension to each connecting pile of the double velvet fabric. One method to cut the third fibrous component 6 is to apply a pushing force to the middle of each connecting pile made by the yarn 7 in a direction perpendicular to this portion. Another method is to apply a force to pull apart the two ground constructions. FIG. 6B shows the cutting of the third fibrous component 6.

If the third fibrous material 6 can be dissolved by a certain chemical agent, including water, such chemical treatment can be applied to remove the fibrous component 6 before sliding separation.

Experiments have confirmed that the third fibrous material can be effectively cut by vibrating action or a pushing action of a member without a knife edge, instead of the cutting knife normally used for creatin pile fabric from the double velvet woven or knitted fabric.

In the case of producing the intermediate pile cloth to produce the artificial fur by utilizing the intermediate pile cloth provided with numerous looped piles, the abovementioned method of dissolving the third fibrous material can be effectively applied.

According to our research work, it has been confirmed that, if only the third fibrous material 6 is first cut by using a sharp knife, in spite of some possibility of cutting some fibrous material contained in the pile, such utilization of the sharp knife is very useful in breaking the continuity of the looped fibers and subsequently creating sliding separation.

This modified technical idea is very useful when using the above-mentioned second yarn. Since the yarn is provided with twists, even if the number of twists is very low, the component fibers of the yarn mutually interfere with each other. Therefore, it is practical to first cut a part of each pile of the intermediate pile cloth, because when this part is cut, the tension applied to the pile concentrates on the remaining fibers in this portion and the above-mentioned mutual interference is simultaneously broken so that the above sliding separation is achieved more effectively. When using a first group of fibrous material much longer and thicker than the second group of fibrous material and having tapered thin free ends, experimentation has confirmed that the above-mentioned sliding separation is carried out very smoothly and effectively when reducing the possibility of cutting this first group of fibrous material. This is the case even when using a separating member having a sharp knife edge, to provide the pushing force or combination pushing force and shearing force to the piles. In experimental tests, when the pile projecting upward from the ground construction was carefully observed, it was found that the tapered tips of the guard hair of the artificial fur were not seriously damaged by the sliding separation, even when using a separating member having a sharp knife edge. It is understood that the principal reason that the tapered tips of the first group of fibrous material were not substantially damaged is mainly dependent upon the shape of this fibrous material. This allows for the avoidance of the action of the sharp edge of the separating member during sliding separation. As each connecting pile connecting the two ground constructions of the intermediate pile cloth or each looped pile projecting upward from a ground construction is partially cut by a separating member provided with a sharp knife edge, there is a possibility of cutting the first and second groups of fibrous material. Therefore, when the method of the present invention is applied, it is important to control the above-mentioned cutting of a part of the yarn so as to cut the first group of fibers as little as possible. This control can be achieved by using a specific separating member provided with a partially sharp knife edge.

Next, the improved method for manufacturing artificial fur according to the present invention is explained in more detail with reference to drawings indicating the preferred embodiments.

The embodiment using intermediate pile cloth having the double velvet weave construction is explained hereinafter.

Figure 9A:
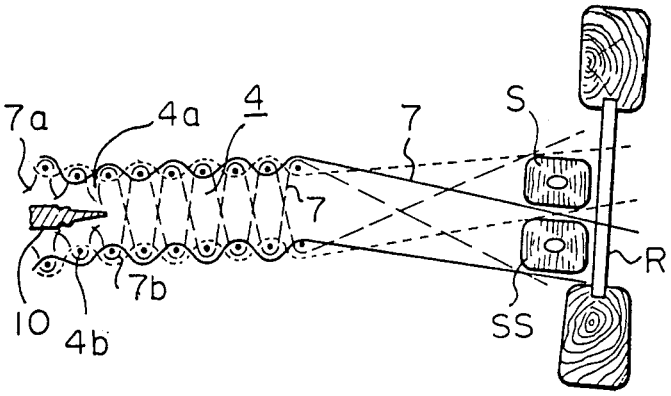
FIG. 9A is a schematic side view of a part of the apparatus for manufacturing intermediate pile cloth having a double velvet weave construction.
Figure 9D:
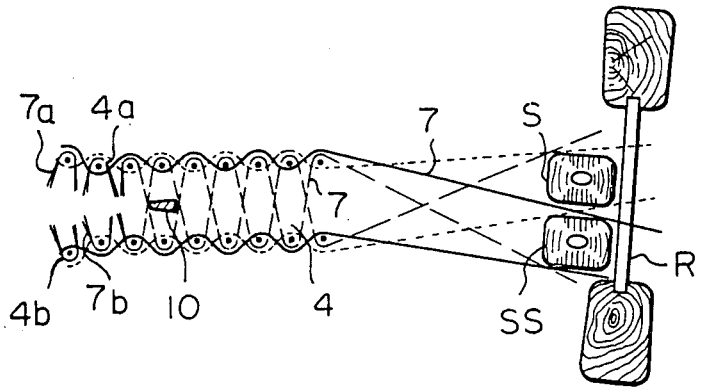
FIG. 9D is a schematic side view of a part of another apparatus for manufacturing intermediate pile cloth having a double velvet construction which is a modification of the apparatus shown in FIG. 9A.
Figure 9B:
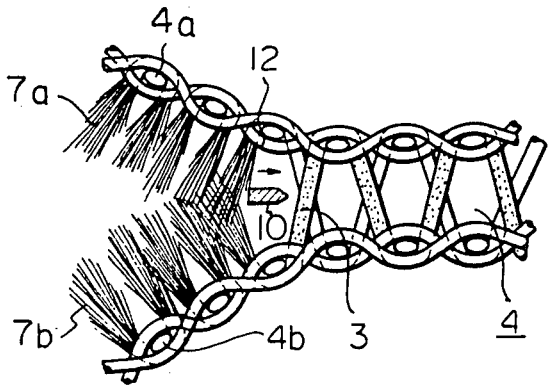
FIG. 9B is an enlarged side view of a part of the apparatus shown in FIG. 9A.
Figure 9C:
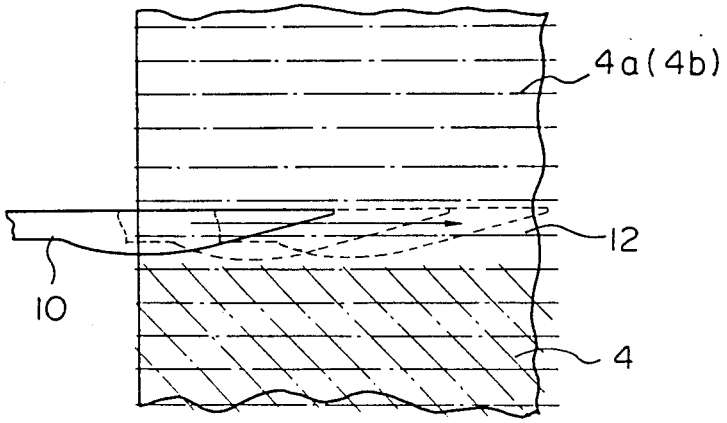
FIG. 9C is a schematic plan view of a part of the apparatus shown in FIG. 9A.
Figure 10A:
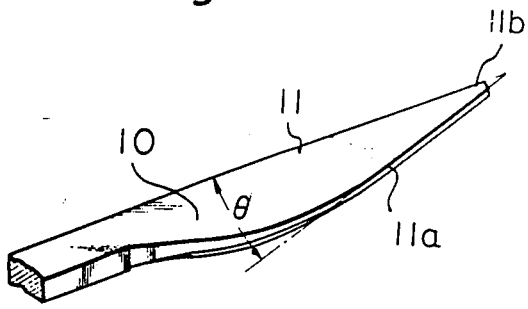
FIG. 10A is a schematic perspective view of a separating member utilized for the apparatus shown in FIG. 9A.

FIG. 9A shows a schematic side view of double fabric plush weaving, wherein S and SS represent two shuttles respectively and R represents a reed of the weaving loom. After the double velvet fabric is created, the continuity of each connecting pile made by the yarn 7, connecting the two ground construction weaves 4*a* and 4*b*, is broken by applying the pushing force of a separating member 10 at an intermediate stopping stage just before the displacement of the connecting pile. As shown in FIGS. 9A and 9B, the separating member 10 is positioned at the point of separation of the front end of the double velvet fabric 4 into two pile weave constructions 4*a* and 4*b* so as to separate the connecting pile into two parts. One of the typical embodiments of the separating member 10 is shown in FIG. 10A. The separating member 10 is provided with a knife portion 11 with a working edge 11*a* and a sharpened tip portion 11*b*.

In this embodiment, the working edge 11*a* is not so sharp. This separating member 10 is capable of reciprocal displacement along the weft yarn of the double velvet fabric 4, in such a manner that the separating member 10 is displaced into the double velvet fabric 4. The double velvet fabric is displaced toward the member 10 as the woven fabric produced by the weaving loom is taken up. The working edge 11*a* faces an alignment of the connecting pile located at the front end of the double velvet fabric 4. The pushing force of the member 10 is mainly applied to the alignment of the connecting pile located at the front end of the double velvet fabric 4. Therefore, this pushing force creates tension in each connecting pile located at the front end of the double velvet fabric 4.

The shape and displacement speed of the separating member 10 is determined so as to create the tension which is sufficiently strong to break the continuity of each connecting pile under the above-mentioned principle. Therefore, when the separating member 10 is displaced into the space in front of the front end of the double velvet fabric 4, each connecting pile made by the yarn 7 at the front end of the double velvet fabric 4 is divided into two portions 4*a* and 4*b* as shown in FIGS. 9A and 9B.

In this process, when the yarn has a construction like the yarn shown in FIG. 6A, the pushing force first breaks the third fibrous material spirally surrounding the core portion of the yarn and then separates the fibers forming the core portion of each pile into two groups 4*a* and 4*b* as shown in FIGS. 9A and 9B, wherein the fiber group 4*a* if firmly held by the ground construction, 4*a*, while the fiber group 4*b* or 7*b* (FIG. 9B) is firmly held by the other ground construction. Fibers not to be held by either ground construction are held by one of the groups of fibers 7*a* or 7*b* in an easily separable condition or are removed from the working position of the separating member 10.

Experimentation has confirmed that the larger the distance between the inside surfaces of the two ground constructions of intermediate pile fabric 4 having a double velvet weave construction, the greater the quantity of wasted fibrous material arising from the above mentioned free fibers, that is, those not too firmly held by either ground construction. In other words, the amount of wasted fibrous material can be effectively reduced by choosing a distance not shorter than the length of the first group of fibrous material forming the guard hair of the artificial fur.

In the above-mentioned embodiment, the separating member 10 applies its pushing force from the outside of the double velvet fabric 4. Experiments by the present inventors, however, showed similar results if the separating member 10 applies its pushing force to the connecting pile from inside of the double velvet fabric 4 as shown in FIG. 9D.

According to our experimental tests, it was confirmed that the taper angle $\theta$ of the working portion of the separating member 10 is preferably in a range between 5° and 45° and that the length of the tapered working edge 11*a* is preferably in a range between 5 mm and 200 mm.

In the research, it was confirmed that if the two pile fabrics having the ground constructions respectively are pulled apart, additional tension is applied to the connecting pile made by the yarn 7 at the front end of the double velvet fabric 4 beside the tension created by the action of the separating member 10, and thereby more effectively breaks the continuity of the connecting pile.

If the above-mentioned third fibrous material spirally surrounding the core portion of the yarn 7 is weak enough to break with the additional tension created by pulling apart the two ground constructions, one can omit the use of the separating member 10. If the third fibrous material is soluble in a certain chemical agent, one can treat the material pile cloth with this chemical agent, and omit the use of the separating member 10. Pulling apart the two ground constructions would be sufficient to create two pile fabrics.

As previously mentioned, one can use a yarn having a configuration similar to conventional spun yarns, if the length, thickness and other characteristics of the first group of fibrous material, forming the guard hair of the artificial fur, are quite different from those of the second group of fiber material, forming the underfur of the artificial fur. However, it is preferable to apply a modified method wherein a combination of a pushing force and a shearing force is utilized so as to practically carry out the process for manufacturing the artificial fur according to the present invention. In such cases, it is also preferable to first cut part of each pile which connects the two ground constructions of the double velvet fabric; then the remaining portion of each connecting pile is separated by the pushing force of the separating member 10, as in the first embodiment.

Figure 10B:
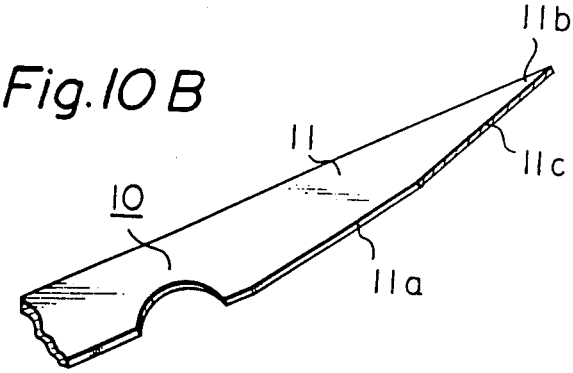
FIGS. 10B and 10C are schematic perspective views of modifications of the separating member shown in FIG. 10A.

Experimentation has shown that one can effectively use a separating member 10 having a similar shape to the member 10 shown in FIG. 10B, wherein a sharp knife edge 11*c* is formed at the free end. When using this separating member 10, the sharp knife edge portion 11*c* works to cut part of the outside of each connecting pile, while the remaining edge works to create sliding separation of each pile by a pushing force of the remaining edge of the member 10.

Figure 10C:
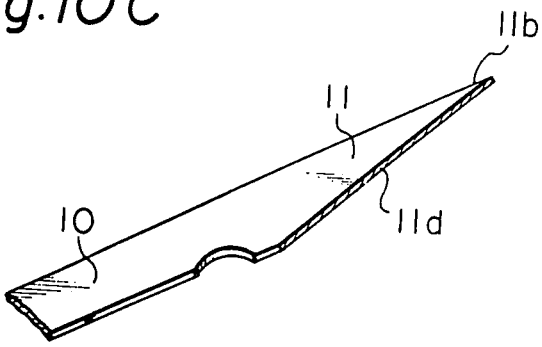
Figure 15:
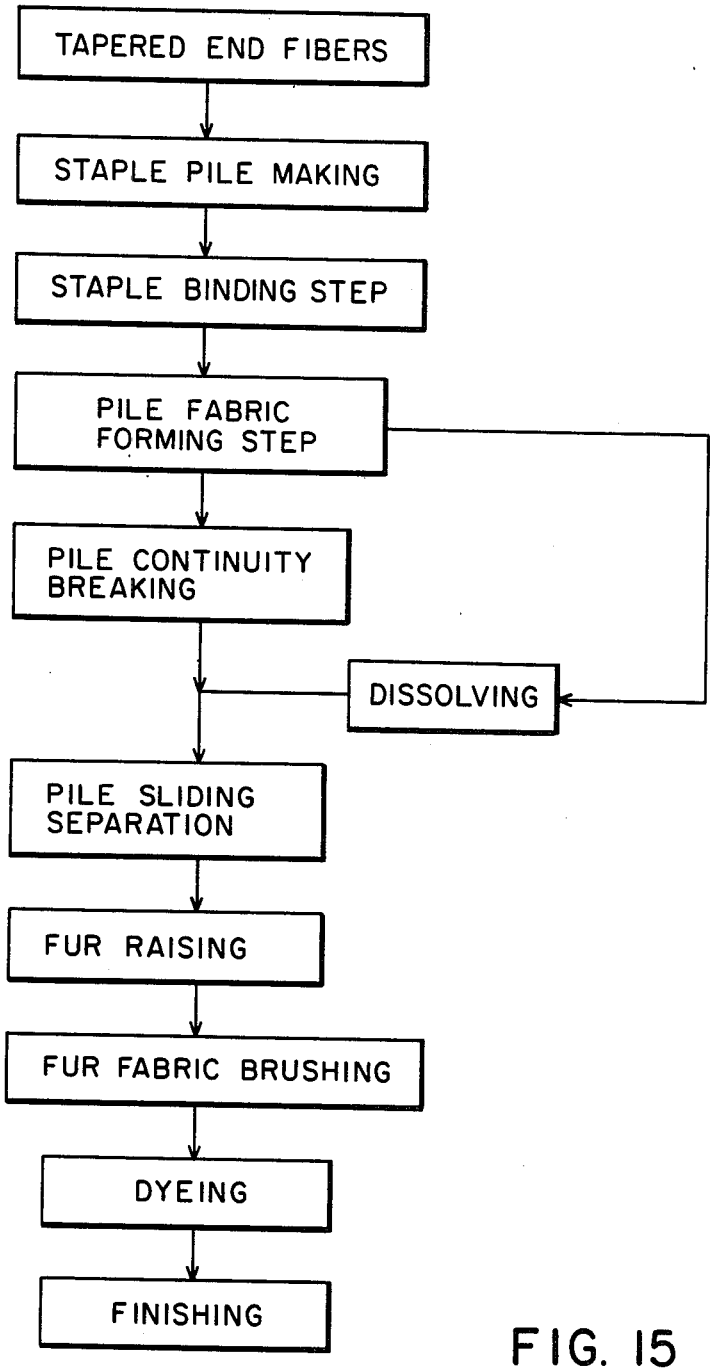
FIG. 15 is a block diagram illustrating one embodiment of the invention.

FIG. 10C shows another separating member 10 which can be used to produce artificial fur according to the presen invention. The separating member 10 allows at least some of the first group of fibrous material to escape from cutting, but cuts all of the second group of fibrous material during the breaking of the continuity of the connecting pile made by the yarn 3. As shown in FIG. 10C, this separating member 10 is provided with a sharp knife edge 11*d*. For example, if such yarn, composed of a spun yarn formed by the first group of fibrous material and a multifilament yarn which will be cut to form the underfur of the artificial fur which were twisted with each other to substantially eliminate the twist of the spun yarn, is used to form the pile of the intermediate pile cloth of double velvet weave construction, and the thickness of the first group of fibrous material is remarkably thicker than the thickness of an individual filament of the multifilament yarn, and the mechanical properties of the former are much better than the latter, there is a strong possibility that the latter one (multifilament yarn) will be cut by the sharp knife edge 11*d* of the member 10 while most of the fibers of the former are capable of escaping from the cutting action of the knife edge 11*d* of the member 10. The sliding separation of the first group of fibrous material is created when pushing and shearing forces of the separating member 10 are applied to the connecting pile at the front end of the double velvet fabric 4 which is the intermediate pile cloth. One form of method for performing the invention is summarized in FIG. 15, as typically performed for the manufacture of the fur.

In U.S. Pat. No. 4,415,611, the preferable construction of the artificial fur was explained. From this explanation, it is understood that the ground construction of the artificial fur must be well covered by underfur and the underfur must be well protected by the guard hair. In addition, the ground construction must have qualities such as stiffness and weight similar to those of the skin of genuine fur. It is also necessary to consider the color of the raw material for the pile fibers and the ground construction of the artificial fur. Consequently, one must take great care in designing the artificial fur to choose the optimal raw material for the pile fibers and the ground construction, the optimal construction of the pile yarn and intermediate pile cloth, as well as the optimal method of inducing sliding separation to break the continuity of the pile.

The preferred fibrous materials, the yarns, the intermediate pile cloths, for producing the artificial fur by the method and apparatus according to the present invention are hereinafter explained in detail.

For ease of understanding, the typical construction of the artificial fur produced by the method and apparatus according to the present invention is hereinafter explained before explaining the results obtained by the experimental tests.

Figure 11A:
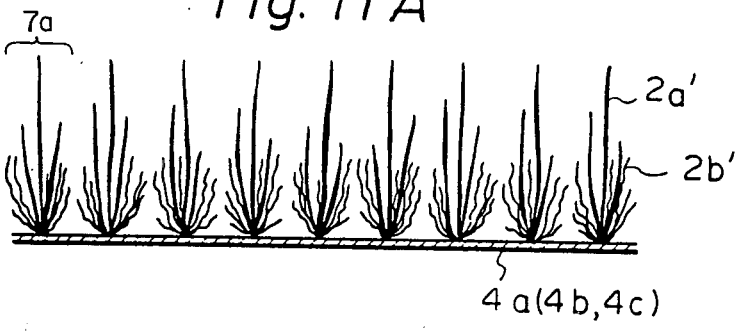
FIG. 11A is a schematic side view of a typical artificial fur produced by the method and apparatus according to the present invention.

As shown in FIG. 11A, the typical artificial fur produced by the method and apparatus according to the present invention comprises a ground construction 4a (4b, 4c) and a plurality of units of pile fibers projecting upward from this ground construction. Each unit of pile fibers 2a 2b is provided with a yarn-like bundle at its root portion, at least a main part of this root portion is firmly locked in the ground construction. The pile fibers 2a and 2b of each unit are separated from each other from above its root portion. The pile fibers 2a and 2b are made from fibrous materials and are provided with varied lengths ranging from almost zero to almost the maximum length of the fibrous materials. In this artificial fur, the above-mentioned pile fibers partly comprise relatively short and fine fibers 2b (second group of fibers), which constitute the underfur, and partly comprise relatively large diameter straight fibers 2a (first group of fibers) projecting from the underfur as guard hair. The guard hairs are substantially tapered at each free tip.

Figure 12A:
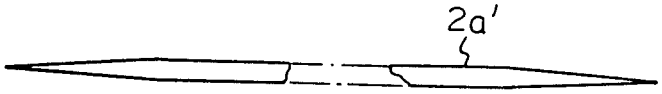
FIGS. 12A and 12B are schematic side views of a fibrous material forming the guard hair of the artificial fur produced by the method and apparatus according to the present invention, respectively.
Figure 12B:
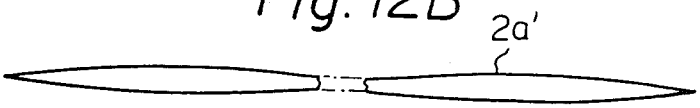

The preferred material for the first group of fibrous material 2a is one much thicker and longer than the second group of fibrous material 2b and has two tapered free ends as shown in FIG. 12A. This is required because the first group of fibrous material 2a is randomly blended with the second group of fibrous material 2b when the material yarn is produced. Experiments by the present inventors have shown that one can also use a modification of the first group of fibrous material 2a shown in FIG. 12B for the first group of fibers in the present invention. When each fiber of the first group of fibrous material 2a has the abovementioned particular shape characterized by the tapered free ends, it is the inventors' understanding that the tapered free ends of the fibrous material easily escape from the cutting action of the sharp knife edge of the separating member while easily escaping the interference from fibrous material moving in the opposite direction during the sliding separation.

The preferred material for the second group of fibrous material includes various types. For example, staple fiber may be blended with a first group of fibrous material when the spun yarn is produced, or a multifilament yarn formed by a plurality of thin individual filaments may be used. In the latter case, the individual filaments are cut by a separating member having a sharp knife edge which creates sliding separation so as to break the continuity of the pile of the material pile cloth.

For the fibrous material, one can use fibrous material having triangular, square, irregular, elliptical, or other type cross sections.

In addition to the above-mentioned conditions for the fibrous material to be used in manufacturing the artificial fur according to the present invention, it is also important to carefully select the optimal relation between the length and thickness of the first group and the second group, as well as the mixing ratio thereof in the yarn forming the pile of the intermediate pile cloth. When using intermediate pile cloth having two ground constructions connected by connecting pile projected from the respective ground constructions, it is preferable to satisfy such conditions that the length ratio (length of the first group of fibrous material)/(length of the second group of fibrous material) is in a range between 1.0 and 5.0. If the first length-to-second length ratio is below 1.0, or above 5.0, it is quite difficult to produce a pile cloth having good quality. For the mixing ratio of the two materials in the pile yarn, it is preferable that the blend ratio of the first group of fibrous material to the second group of fibrous material be in a range between 15 and 70% by weight.

It has also been confirmed that a distinctive difference between the lengths of the two groups of fibrous material results in an excellent appearance in the final product. However according to the research conducted by the present inventors, it is desirable that the second group of fibrous material has its fiber length in a range between $\frac{1}{2}$ and $\frac{1}{3}$ of the length of the first group of fibrous material. If a conventional spun yarn is used as a pile yarn, since a low twist thereof is preferable to smoothly carry out the breaking of the continuity of the piles formed in the intermediate cloth, it is further preferable to use such second group of fibrous material having sufficient crimp so as to assist in the stable formation of yarn.

Regarding the relation between the length of pile or loop pile of the intermediate pile cloth and the length of the first group of fibrous material, it is understood that the length of the pile is defined by the length of the first group of fibrous material in such a way that the length of the former is not shorter than the latter. In practice, one chooses for the first group of fibrous material, a length in a range between 10 and 75 mm, preferably between 15 and 40 mm, and most preferably between 15 and 30 mm.

Experimentation on the thickness of the fibrous materials, has shown that the preferred ratio of the average thickness of the first group of fibrous material to the second group of fibrous material is in the range between 10 and 100. For example, one would choose a thickness of the fibrous material of the second group in a range between 1 denier and several deniers, while the thickness of the first fibrous material is in a range between scores and 100 deniers.

Regarding the mixing ratio in relation to the thickness of the fibrous materials, a particular experimental test was conducted. Example 1, which will be explained later, is involved in this experimental test, with the following concuusion. To produce the artificial fur having the desired quality, it is necessary to carefully select the fibrous material regarding the above-mentioned mixing ratio in relation to the thickness of the fibrous materials so as to satisfy the condition defined by the following equations (1) and (2).

$$15 \leqq D \leqq 80 \quad (1)$$

$$\frac{50D}{50 + D} \leqq R \leqq \frac{450}{D} + 55 \quad (2)$$

where

D designates the thickness of the thickest portion of the first fibrous material in denier, R designates the mixing ratio of the first fibrous material in the yarn in weight % and R is calculated by the following equation $$R = \frac{A}{A+B} \times 100$$

wherein

A designates the weight of the first group of fibrous material contained in a unit weight of the yarn, B designates the weight of the second group of fibrous material contained in a unit weight of the material yarn.

Figure 14:
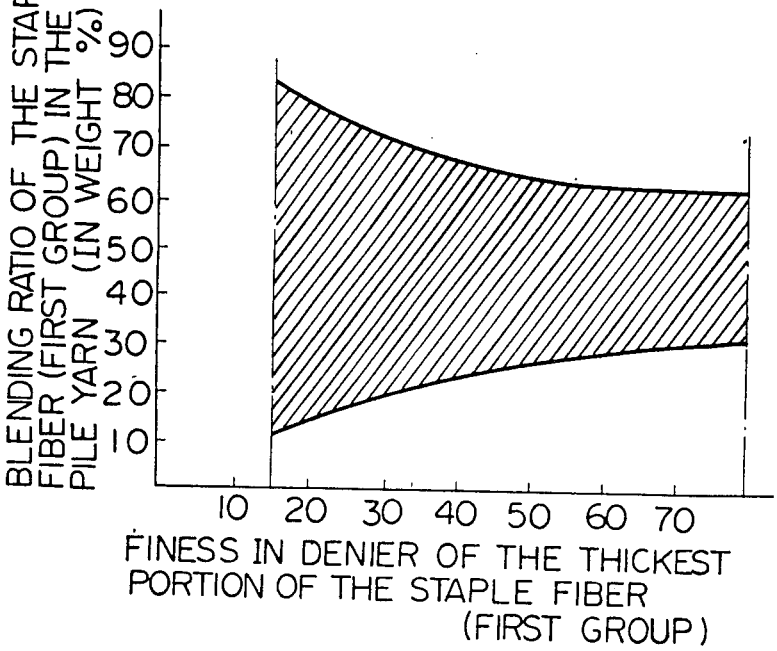
FIG. 14 is a diagram indicating the relation between the blending ratio of the staple fiber (first group) in the pile (in weight %) and fineness in denier of the thickest portion of the staple fiber (first group) regarding a preferable embodiment to produce artificial fur according to the present invention.

As mentioned above, it is necessary to choose the first group of fibrous material so as to satisfy the condition defined by the equation (1). If the thickness of the thickest portion of the first group of fibrous material is less than 15 deniers, the resilience of the guard hair of the artificial fur is so weak that the hand of the artificial fur becomes deficient. If the above-mentioned thickness is thicker than 80 denier, the hand of the artificial fur becomes coarse so that the quality of the final product is poor. To create an excellent quality of artificial fur, it is also necessary to satisfy the condition defined by equation (2). The relation defined by the two equations (1) and (2) is represented by a diagram shown in FIG. 14. If R is below 50D/(50+D), the guard hairs do not stand out distinctively in the artificial fur and its hand is incorrect. On the other hand, if R is above (450/D)+55, the guard hair stnds out distinctively in the artificial fur, producing an appearance in the artificial fur which is rich, but the guard hair becomes so stiff that the flutter characteristics are poor and the mix of the guard hair with the underfur is wrong. Such artificial fur has a hand much coarser than that of genuine fur.

As to the above-mentioned fibrous material, known artificial fiber materials such as polyester, polyamide, acrylic, polyolefin, protein fibers, rayon and acetate and natural fiber materials such as wool, cotton, flax, silk, etc. can be selectively utilized.

Figure 11B:
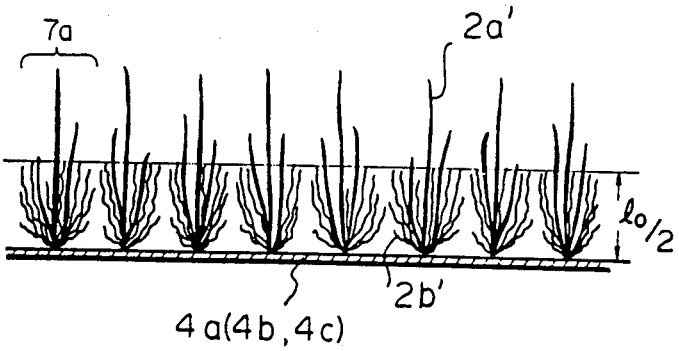
FIG. 11B is a schematic side view of a modified artificial fur produced by the method and apparatus according to the present invention

As already briefly explained, various yarns can be utilized to form the pile of the intermediate pile cloths. Examples of such pile forming yarns include: conventional spun yarns; composite yarns having an island-in-sea polymer fiber wherein the island component becomes the guard hair of the final product; yarn composed of doubled component yarns; twisted yarns such as a conventional twisted yarn composed of a pair of component spun yarns, or composed of a conventional spun yarn spirally surrounded by a component filament yarn, or composed of a pair of multifilament component yarns. However, the basic technical idea of this invention is the sliding separation of at least the first group of fibrous material so as to break the continuity of the pile of the intermediate pile cloth. Therefore, it is preferable that the yarns be modified so as to be as similar as possible to the ideal construction shown in FIG. 1. For example, if a spun yarn is used, the twist number must be reduced to as low as possible. Therefore, it is preferable to use fibrous material having a comparatively longer-length than is used in the conventional spun yarns. It is also preferable to use a second group of fibrous material having sufficient crimp so as to contribute to the increase in the strength of the yarn. If the fiber length of the first and second fiber groups is longer than half of the length $l_0$ of the connecting pile which connects two ground constructions of an intermediate pile cloth having a double velvet weave construction, or is longer than ½ of the length of the looped pile of an intermediate pile cloth, application of a separating member to break the continuity of the pile enables the creation of artificial fur of the construction shown in FIG. 11B. Research by the present inventors has shown that such spun yarn composed of a first group of fibers for the guard hair, a second group of fibers for the underfur and a third group of fibrous material to provide sufficient yarn strength for the weaving operation, can be effectively used if the third group of fibrous material can be easily removed from this yarn. For example, if the third group of fibrous material is a fiber of polyvinyl alcohol resin which is soluble in water, this third fiber component can be easily removed from the yarn by a known wet processing. Removal of such third component fibers from the yarn significantly loosens the construction of the yarn in the intermediate pile cloth, resulting in the necessary condition for the manufacturing method of the present invention.

When a spun yarn having a conventional construction is used, it is also possible to treat this yarn with an agent which can be easily removed therefrom, so as to fix the yarn construction. For example, a water-soluble polyvinyl alcohol resin may be used to fix the yarn construction. After fixing the yarn construction using this agent, the yarn is untwisted. However, in this condition the yarn retains strength sufficient to carry out the weaving operation to produce the intermediate pile cloth, because the initial yarn strength is still maintained. This intermediate cloth is subjected to a chemical treatment to remove such a fixing agent. This significantly loosens the construction of the pile made by the yarn. Consequently, a preferred construction of the pile for breaking the continuity of the pile of the intermediate pile cloth is created.

The following fibrous materials are effective as a third group of fibrous material to be removed: polyester material which is soluble in alkaline solutions when the fibrous material for the guard hair is polyamide material; polyamide material which is soluble in pseudo-acids when the first group of fibrous material is polyester; acrylic fiber which is soluble in such solvent as dimethylformamide, dimethylsulfoxide, Rhodanic acid and Nitric acid; Styrene fiber which is soluble in trichlorine, Benzene and Xylene; polyester produced by copolymerization with Sodium-Sulfoisophthalate which is soluble in alkaline solution.

Figure 7A:
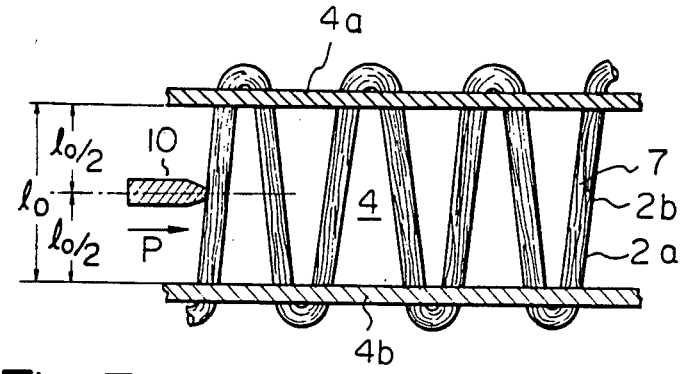
FIG. 7A is a schematic side view of an intermediate pile cloth having a double velvet weave construction with a separating member to act on about the middle of the connecting pile which connects the two ground constructions thereof, according to the present invention.
Figure 8A:
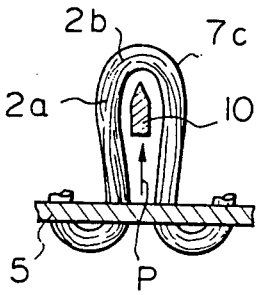
FIG. 8A is a schematic side view of an intermediate pile cloth provided with a plurality of loop piles with a separating member to act on about the middle of a loop pile thereof.
Figure 8B:
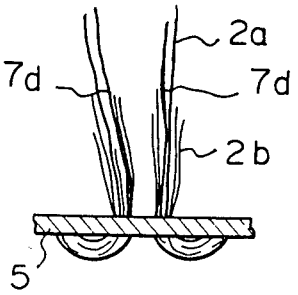
FIG. 8B is a schematic side view of a pile cloth after breaking the continuity of the loop pile shown in FIG. 8A.
Figure 13:
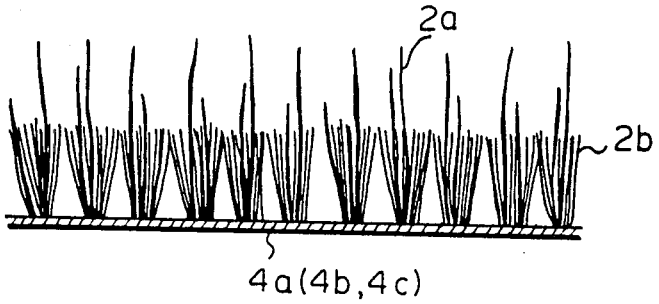
FIG. 13 is a schematic side view of another modified artificial fur produced by a modified method and apparatus according to the present invention.

The same research has further shown that a double yarn consisting of a spun yarn formed only by a first group of fibrous material, twisted together with a multifilament yarn consisting of individual filaments to form the underfur of the artificial fur can be effectively used. The twist of the spun yarn is substantially eliminated when the abovementioned two yarns are twisted. Since the individual filaments of the above-mentioned multifilament yarn become the underfur of the final product, care must be taken in choosing or designing the thickness and the length of the pile of the intermediate pile cloth when using such double yarn for the intermediate pile cloth as shown in FIGS. 7A and 8A. Care must also be taken in the application of a separating member having a sharp knife edge in such a manner so as to cut the filaments, while slide-separating the remaining fibrous materials of the pile. The working position for the separating member shown in those drawings, enables the creation of artificial fur having underfur formed by short pile fibers of identical length as shown in FIG. 13.

As to the typical type of yarn utilized to form pile in the intermediate pile cloth, a yarn consisting of a conventional spun yarn formed by a first group of fibrous material and a second group of fibrous material, with a multifilament yarn spirally surrounding the spun yarn is preferably utilized. In this case, the twist of this spun yarn is eliminated when the two yarns are twisted. If the multifilament yarn is cut or eliminated by chemical treatment before sliding separation of the connecting pile which connects the two ground constructions of the intermediate pile cloth, or the looped pile of the intermediate pile cloth, the most desirable condition of the yarn construction of pile of the intermediate pile cloth is created. Therefore, this type of yarn is the most preferable yarn.

The preferred intermediate pile cloth includes various materials such as double velvet fabric, double pile knitted fabric, loop pile fabric, loop pile knitted fabric, and loop pile tufted cloth provided with a ground construction of fabric woven, knitted or non-woven cloth.

To lock the pile fibers to the ground construction, it is preferable to apply backing treatment to the intermediate pile cloth before breaking the continuity of the pile of the intermediate pile cloth. A detailed explanation is omitted, as the operation is similar to that disclosed in U.S. Pat. No. 4,415,611. Besides the above-mentioned backing operation, particular consideration is paid to the design of the construction of the intermediate pile cloth. For example, when using pile cloth having a double velvet fabric construction, it is preferable to use the fast pile construction instead of the loose pile construction.

Research has shown that treatment of the intermediate pile cloth by an agent to ease the sliding of the fibrous material from the other material facilitates breaking the continuity of the pile by sliding separation without undesirable breaking of the first group of fibrous material. Such auxiliary finishing treatment by an agent such as an oiling agent can be applied.

The preferred ground construction of the intermediate pile cloth must also be considered as the properties thereof affect the qualities of the final artificial fur, such as the hand or drapability. For example, if good drapability is to be provided, it is desirable to use a thin ground construction or to increase the flexibility or stretchability of the ground construction. Imparting these particular properties to the ground construction facilitates the sewing of garments. To achieve these properties, one can use various yarns such as: yarn provided with fibrous material easily removed from the yarn by additional chemical treatment; yarn composed of splittable fibrous material; multifilament yarn formed by very fine individual filaments; and stretch yarn. In such a case, one generally applies a suitable auxiliary finishing treatment, such as a backing treatment to impart a leather-like quality to the ground construction.

For the preferred finishing of the pile cloth, the final process for manufacturing the artificial fur includes a raising operation carried out to raise the pile fibers projecting upward from the ground construction of the pile cloth while separating pile fibers of each unit thereof, and a brushing operation to remove the free fibers which are not firmly held by the ground construction of the pile cloth. However, because these finishing processes are disclosed in U.S. Pat. No. 4,415,611 the explanation thereof is omitted except for the following new matter. If fibrous material having fiber length almost identical to the length of the pile of the intermediate pile cloth is used, it is as the second group of fibrous material. It is preferable to break each such fibrous material of this second group by applying the scratching force created by a raising and/or brushing operation, so as to shorten the length of the second group of fibrous material projected upward from the ground construction. In such case, it is therefore preferable to use a thin and weak second group of fibrous material.

EXAMPLE 1

Fourteen kinds of blended spun yarn having a yarn count of 7–10 S (cotton counting system) were made by using four kinds of polybutylene terephthalate staple fibers (hereinafter referred to as PBT) having fiber deniers of 20d, 30d, 50d and 75d but having the same fiber length, 37 mm and having tapers on both ends as guard hair and using cotton fiber as underfur in the blending ratios described in Table 1. Then, eighteen kinds of cut pile fabrics were produced from velvet fabrics which were produced by using the above-mentioned blended spun yarns as pile yarn and 15 S/2 spun yarn composed of polyester staple fibers 1.5d×51 mm as both warp and weft yarns in ground construction of double velvet fabric and then separating those intermediate pile cloths into upper and lower pile fabrics by applying separating force to the intermediate fabric as shown in FIG. 7A. The length of the connecting pile was set at 39 mm in all examples.

After backing the pile fabrics thus produced with 15% polyurethane dimethylformamide solution, washing, extracting and drying were carried out on the eighteen kinds of pile fabrics.

Then, the pile of each fabric was completely opened from the top to the root portion thereof by a brushing treatment to eliminate the twist of the pile. At the same time, the cotton fibers and the PBT staple fibers having tapered portions on both ends, which were not held by the ground construction were also removed.

Figure 7B:
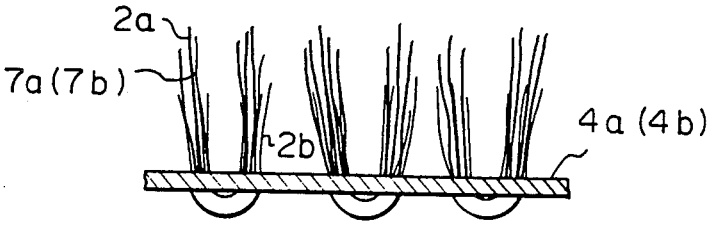
FIG. 7B is a schematic side view of a pile cloth produced from the intermediate pile cloth shown in FIG. 7A.

Consequently, eighteen kinds of artificial fur having a structure as shown in FIG. 7B were obtained.

The results of the evaluation of each fur like pile fabric are described in Table 1.

TABLE 1

| Thickness of fiber in denier | Blending ratio staple fiber as guard hair R(%) | Results of evaluation: Appearance of fabric | Hand of fabric | Pile characteristics of guard hair and underfur |
|---|---|---|---|---|
| 20 | 13(comparative) | x | Δ | o |
| | 22(this invention) | o | o | o |
| | 30(this invention) | o | o | o |
| | 60(this invention) | o~ | o | o |
| 30 | 15(comparative) | x | Δ | o |
| | 24(this invention) | o | o | o |
| | 30(this invention) | o~ | o | o |
| | 60(this invention) | o | o | o |
| | 75(comparative) | o | x~Δ | o |
| 50 | 23(comparative) | x | x | o |
| | 32(this invention) | o | o | o |
| | 45(this invention) | | o | o |
| | 60(this invention) | | o | o |
| | 65(comparative) | o~ | x~Δ | x |
| 75 | 25(comparative) | x | x | o |
| | 33(this invention) | o | o | o |
| | 55(this invention) | | o | o |
| | 65(comparative) | o | x | x |

Note
x designates Low grade,
Δ designates Ordinary grade
o designates Good grade,
designates Excellent grade

EXAMPLE 2

Two kinds of blended spun yarn were produced using different kinds of PBT staple fiber, having fiber deniers of 30d and 50d, respectively, and a fiber length of 37 mm but without tapers on both ends as guard hair, and using cotton fiber as underfur.

With 30d PBT staple fiber, the blending ratio R was set at 30% and the yarn count was 10S. With 50d PBT staple fiber, the blending ratio R was set at 45% and the yarn count was 95.

Using these blended spun yarns to create the pile in pile fabrics, two kinds of pile fabrics were produced by utilizing the weaving and finishing operations described in Example 1.

The furlike pile fabrics thus obtained were superior in that their guard hair covered the surface of the pile fabrics effectively, but the absence of tapers at the ends of the guard hair resulted in an artificial appearance and a hand which was not very smooth.

Moreover, the characteristics of the pile, such as fluttering were inferior to those of the fabrics of Example 1, because the roots of the guard hair, even those having long fiber length were not tapered and were not straight.

EXAMPLE 3

Two kinds of blended spun yarn were produced by using different kinds of PBT staple fiber, having fiber deniers of 10d and 85d, respectively, and a fiber length of 37 mm, and further having tapers on both ends as guard hair and using cotton fiber as underfur.

With 10d PBT staple fiber, the blending ratio R was set at 45% and the yarn count was 10S. With 85d PBT staple fiber, the blending ratio R was set at 50% and the yarn count was 7S.

Two kinds of pile fabrics were made by using these blended spun yarns to create pile in the fabrics, the continuity of each pile of the intermediate pile fabrics was separated and finishing operations of the thus produced pile fabrics were carried out as described in Example 1.

The 85d PBT staple fiber, resulted in a pile fabric having a coarse and rough hand. Accordingly, the characteristics and quality of the pile fabrics in this example were inferior to those of the excellent natural furlike pile fabric obtained according to the present invention in Example 1.

EXAMPLE 4

A core spun yarn having a yarn count of 16S (330d) and twist number of 540 T/m(Z) was produced with a conventional ring spinning machine by using rayon multifilament yarn of 210d-105f as underfur and roving yarn composed of PBT staple fibers 18d×35 mm having tapers on both ends as guard hair.

A rayon multifilament yarn of 50d–24f was plied with the above-mentioned core spun yarn and it was twisted to 500T/m in the S direction with a ring twister.

The yarn thus obtained had a yarn construction such that a rayon multifilament yarn 50d-24f was wrapped around a core spun yarn having substantially zero twist.

An intermediate pile fabric having a double velvet weave structure was produced with a double velvet weaving loom by using the yarn thus produced for creating connecting pile and polyester spun yarn 30/2S for creating the two ground constructions. The yarn densities of each ground construction were 44×44 (warp×weft) ends/inch, while the pile densities in the directions of warp and weft were 22×20 piles/inch, and the distance between the two ground constructions was 35 mm, in the intermediate pile fabric thus produced. Further, the position of the separating member was set at the center portion between two ground constructions and the continuity of the connecting pile was broken without cutting the guard hair staple fibers, while cutting the wrapping filament and underfur staple fibers. The separating member was provided with a blade having the configuation as shown in FIG. 10C in which the taper angle $\theta$ was 15° and the length of the taper was 115 mm, this taper having a knife edge capable of cutting only the rayon filaments.

The greige pile fabric thus obtained was subjected to backing with a 15% polyurethane dimethylformamide solution and then was washed, extracted and dried.

Finally, brushing and elimination of free fibers were carried out on the pile fabric.

The cut pile fabric thus obtained after drying and finishing treatment had a pile structure similar to that of genuine fur and showed natural mink like handling and appearance as depicted in FIG. 13.

EXAMPLE 5

A blended spun yarn having a yarn count of 8S and a twist number of 452 T/m (Z) was produced by a conventional cotton spinning system using 45% of PBT staple fiber 50d×33 mm (without $TiO_2$) as the first group of fibrous material for guard hair and using 55% of polyethylene terephthalate (hereinafter referred to as PET) staple fiber 1.5d×22 mm as the second group of fibrous material for underfur.

This spun yarn was then untwisted by 450 T/m (S) twist on a fancy twister and was simultaneously plied with a water soluble PVA filament yarn at 0% overfeed ratio.

The yarn thus produced was a yarn bundle having a yarn count of 8S, which had substantially no twist, with a wrapping of the water soluble PVA filament yarn.

A double velvet fabric was woven by using this yarn to create pile and by using 40S/2 spun yarn composed of 2d×51 mm island-in-sea typed conjugated staple fiber (island-sea ratio; island/sea=55/45, ultra fine fiber bundle composed of 11 filaments each having O.ld obtainable from one island-sea type conjugated staple fiber after eliminating the sea component) to create two ground constructions. The double velvet fabric thus produced had the following construction:

| | |
|---|---|
| Length of the connecting pile; | 40 mm |
| Pile density (warp direction); | 30 pile units/inch |
| Pile density (weft direction); | 40 pile units/inch |
| Warp density of each ground construction; | 60 ends/inch |
| Weft density of each ground construction; | 60 ends/inch |
| Pile fixing construction; | fast pile system |

The separation of the upper and lower pile fabrics was performed by using a separating member of the type shown in FIG. 10A which could move forward and backward along the center portion of the alignment of the connecting pile and during such operation the continuity of the connecting pile was broken in such a manner that only PVA filament wa cut, but PBT staple fibers and PET staple fibers were slide-separated without cutting or breaking. In this separating member, the angle $\theta$ was 15° and the length of the taper was 115 mm, this taper edge not capable of cutting the fibers but capable of applying pressure to pile.

Consequently, two pile fabrics were produced.

Polyurethane solution was applied to the ground construction of the pile fabric thus produced and thereafter the water soluble PVA filaments were removed.

After drying, the pile fabrics were brushed for opening and finishing.

The pile fabrics thus produced had a pile structure wherein the pile fibers had a suitable distribution of fiber lengths and a distinctive two layered construction of thick PBT staple fibers having longer mean fiber length and of thin PET staple fibers having shorter mean fiber length.

The pile fabric was an excellent artificial fur very similar to genuine fur.

Moreover, the elimination of the PVA filaments made the ground construction very soft, the softness being enhanced after the sea component of the ground construction was removed.

EXAMPLE 6

A blended spun yarn having a yarn count of 10S and a twist of 12 T/m (Z) was produced by a conventional cotton spinning system using 70% of PBT staple fiber 30d×35 mm, having tapers on both ends, as guard hair and using 30% of cotton fiber as a supplemental component for improving the spinning effect (referred to as the third fibrous material).

After applying a softening agent to this spun yarn, the spun yarn was twisted with PET filament yarn 300d-144f as underfur with 472 T/m (S) on a twisting machine.

A double velvet fabric was produced by using this twisted yarn to create the connecting pile, and using 30/2S spun yarn composed of PET staple fibers 2d×51 mm to create two ground constructions. The construction of the double velvet fabric thus produced was as follows.

| | |
|---|---|
| Length of the connecting pile | 36 mm |
| Pile density (warp direction) | 22 pile units/inch |
| Pile density (weft direction) | 18 pile units/inch |
| Warp density of each ground construction | 44 ends/inch |
| Weft density of each ground construction | 36 ends/inch |
| Pile fixing construction | fast pile system such as one float over one weft in ground construction and 12 floats as pile |

Separation of the upper and lower pile fabrics was performed using a separating member provided with a blade which moved forward and backward along the center portion of the alignment of connecting pile.

The separating member was of a similar configuration to that shown in FIG. 10B wherein the taper angle $\theta$ was 5° and the length of the taper was 165 mm in which the 115 mm length from the tip of it had a sharp knife edge capable of cutting PET filament and following 50 mm length had only a dull edge.

The blade broke the continuity of the connecting pile in such a manner that the PET staple fibers and a part of the cotton fibers were cut, and PBT staple fibers were slide-separated without cutting.

Accordingly, two pile fabrics were obtained. After obtaining such pile fabric, a backing treatment was performed by applying polyurethane emulsion to the ground construction, and after washing and drying operations, brushing treatment was applied to the pile of the pile fabric to open the pile. The pile fabric thus obtained had a pile construction such that the length of most of the pile fibers forming underfur were uniformly 18 mm while the fiber length of the pile fibers forming guard hair were varied with a distribution in which the length from a maximum length of 35 mm to a minimum of 0 mm.

The pile fabric thus produced had a natural mink like appearance and hand because this product had a two layered pile structure composed of guard hair and underfur which could be distinguished. Moreover, this product had a soft hand and excellent fluttering characteristics.

Sulfuric acid treatment of this pile fabric to eliminate the cotton fibers from the pile further enhanced the appearance of the two layered structure by making the hand more similar to that of genuine mink.

EXAMPLE 7

A blended spun yarn having a yarn count of 10S and twist number of 473 T/m (Z) was produced by a conventional cotton spinning system by using 50% of PBT staple fiber 50d×31 mm having tapers on both ends as guard hair, and by using 30% of PET staple fiber 4d×20 mm as underfur and 20% of acrylic staple fiber 1.5d×38 mm soluble in weakly alkaline liquid as the third fibrous material having suitable fiber length for improving the spinning ability.

This blended spun yarn was plied with water soluble PVA filament yarn of 50d-18f. Then, this plied yarn was untwisted with 470T/m (S) by a ring twister. A yarn in which water soluble PVA filament yarn spirally wrapped around the substantially non-twisted yarn was obtained.

A double velvet fabric was woven by using the yarn thus obtained to create the connecting pile and by using a 30/2S spun yarn composed of the 2d×51 mm island-in-sea type conjugated staple fiber as mentioned in Example 5 to create the two ground constructions. The construction of the double velvet fabric thus produced was as follows:

| | |
|---|---|
| Length of the connecting pile | 32 mm |
| Warp yarn density of each ground construction | 44 ends/inch |
| Weft yarn density of each ground construction | 36 ends/inch |
| Pile yarn density (warp direction) | 22 ends/inch |
| Pile yarn density (weft | 18 ends/inch |
| Pile fixing construction | fast pile system the same as in Example 6 |

Separation of the upper and lower pile fabrics was performed by using a separating member provided with a blade which moved forward and backward along the center portion of the alignment of connecting pile as shown in FIGS. 9A and 9B.

The blade was of a similar configuration to that shown in FIG. 10B wherein the tip angle $\theta$ was 5° and the length of taper portion was 165 mm in which the portion having a 20 mm length from the tip had a knife edge and the next 95 mm length following this sharp portion, had a duller knife edge. The remaining 50 mm length had an edge capable of only applying pressure to the connecting pile.

The separating member broke the continuity of the connecting pile in such a manner that it cut only the water soluble PVA filaments and slide-separated at least a certain number of the PBT staple fibers without cutting.

This separated the upper and lower pile fabrics to produce two pile fabrics. The pile fabrics were then subjected to backing by using a polyurethane emulsion. The water soluble PVA filaments were then removed by hot water treatment, and the acrylic fibers were completely removed by a weakly alkaline emulsion.

The pile fabrics were washed, dried and then brushed to open the pile.

The pile fabrics thus obtained had pile structure wherein the length of the pile fibers in the pile were naturally distributed. The pile fiber length of the underfur varied from a maximum length of approximately zero, while that of the guard hair fibers varied from a maximum length of 28 mm to a minimum of approximately zero.

Consequently, the pile fabric obtained had a genuine mink like appearance and hand. The fabric had the distinctive two layer pile construction of guard hair and underfur. Furthermore, elimination of the sea component from the ground construction made the ground construction softer.

Accordingly, this made the pile fabric an excellent artificial fur very similar to genuine fur in feeling and appearance.

EXAMPLE 8

A blended spun yarn having a yarn count of 8S and a twist number of 452 T/m was produced by a conventional cotton spinning system by using 40% of PBT staple fiber 30d×35 mm and 60% of PET staple fiber 1.5d×20 mm.

This spun yarn was untwisted by 450 T/m(S) on a fancy twister and was simultaneously plied with a water soluble PVA filament yarn at an over-feed ratio of 25%.

This produced a yarn with a water-soluble PVA filament wrapped around a core fiber bundle of 8S of substantially zero twist.

A double velvet fabric was produced as in Example 5 using this yarn to create the pile and the same yarn as Example 5 for the two ground constructions. The construction of the above mentioned double velvet fabric was as follows:

| | |
|---|---|
| Length of the connecting pile | 40 mm |
| Pile yarn density (warp direction | 30 pile units/inch |
| Pile yarn density (weft direction | 40 pile units/inch |
| Warp density of each ground construction | 60 ends/inch |
| Weft density of each ground construction | 60 ends/inch |
| Pile fixing construction | fast pile system |

This double velvet fabric was then treated to remove the water soluble PVA filament. Elimination of the PVA filaments permits the easy separation of the upper pile fabric and lower pile fabric by applying a separating force to those fabrics without cutting the connecting pile. The pile fabric thus obtained had a pile structure wherein the pile had a suitable distribution of fiber length and a distinguishable two layer construction of guard hair and underfur. Elimination of the sea component from the ground construction yarn, as mentioned in Example 5, made the ground construction softer.

EXAMPLE 9

A blended spun yarn ($F_1$) having a yarn count of 10S and a twisting member of 473 T/m(Z) was produced by using 55% of cotton fiber as underfur and using 45% of PBT staple fiber having tapers on both ends as guard hair.

This spun yarn was then plied with a water soluble PVA filament yarn of 50d-18f and both yarns were simultaneously twisted by 470 T/m(S) on a fancy twister.

This produced a yarn ($F_2$) with a water soluble PVA filament yarn wrapped around a core fiber bundle of 10S of substantially zero twist composed of first and second fibrous materials as shown in FIG. 6A. Next, two kinds of pile fabric were produced by using polyester spun yarn 30/2S for the two ground constructions and using either yarn $F_1$ or yarn $F_2$ as the connecting pile in a double velvet loom. This double velvet fabric had the following construction:

| | |
|---|---|
| Warp and weft density of each ground construction (warp × weft) | 44 × 36 ends/inch |
| Pile density (directions towards warp and weft) | 22 × 18 ends/inch |
| Length of the connecting pile | 32 mm |

The greige pile fabrics thus obtained were then subjected to backing with 15% polyurethane dimethylformamide emulsion, then were washed, extracted and dried.

Elimination of the PVA filaments was performed in the fabric produced with the yarn $F_2$, by hot water treatment at 80° C.

The pile fabrics were then brushed several times to open the pile and remove free fibers.

The weaving efficiency was poor with the yarn $F_1$. In weaving on the loom, the shed could not open smoothly due to some long fluffs of guard hair projecting from the pile. There was also large pile breakage and guard hair detachment.

When yarn $F_2$ was used, weaving efficiency was excellent and fabric quality was also excellent because the type of problems occurring with the weaving of fabric with yarn $F_1$ were extremely small. In brushing, where yarn $F_2$ was used as pile, the pile was completely opened and free fibers were eliminated after 5 brushing repetitions.

On the other hand, where $F_1$ was used as pile, the pile was not opened sufficiently even after 12 brushing operations.

After drying and finishing, the pile fabric using yarn $F_2$ had a hand and appearance closer to genuine mink that did the pile fabric using yarn $F_1$.

EXAMPLE 10

A blended spun yarn having a yarn count of 10S and a twist number of 473 T/m(Z) was produced by a conventional cotton spinning system by using 45% of PBT staple fiber (no crimp) 40d×31 mm having tapers on both ends as guard hair and using 55% of PET staple fiber 1.5d×38 mm as underfur. This spun yarn was then plied with a water soluble PVA filament yarn of 50d-18f and both were simultaneously twisted by 470 T/m(S). This produced a yarn with a water soluble PVA filament yarn wrapped around a core fibrous bundle of 10S of substantially zero twist.

A double velvet fabric was produced by using this yarn to create connecting pile and using the spun yarn 30/2S composed of island-in-sea type conjugated staple fibers shown in Example 5 as the ground construction.

The length of the connecting pile was set at 32 mm and the other construction specifications of the fabric were also the same as in Example 7.

Separation of upper and lower pile fabrics was performed by using a separating member as shown in FIG. 10B which moved forward and backward along the alignment of the connecting piles as in Example 6.

According to the movement of the separating member, continuity of each connecting pile was slide-separated in such a manner that the water soluble PVA filament was surely cut and almost of all PET staple fibers, both ends of which were fixed concurrently in both upper and lower base fabric, also were cut. Therefore, separation of upper and lower pile fabric constructions could be accomplished and two sheets of pile fabrics could be obtained.

It must be noted that during separation, the blade of the separating member slide-separated almost all the PBT staple fibers having tapers on both ends without cutting while cutting most of the 1.5d PET staple fibers because of their low denier, even if one end was free.

EXAMPLE 11

A blended spun yarn having a yarn count of 16S/2 and a twist number of 560Z/443S T/m (initial twist/final twist) was produced by a conventional cotton spinning system by using 70% of PBT staple fiber 30d×35 mm and 30% of water soluble PVA staple fiber 1.0d×35 mm. A double velvet fabric was produced by using this spun yarn as pile yarn to create connecting pile and by using 40S/2 spun yarn composed of 2d×51 mm island-in-sea type conjugated staple fibers in the two ground constructions, wherein the conjugated staple fibers consisted of PET as the island component and polystyrene as the sea component, (island/sea) was 55/45, ultra fine fiber bundle composed of 11 fibers each having 0.1d, after eliminating the sea component. The weave construction of this double velvet fabric was as follows:

| | |
|---|---|
| Length of the connecting pile; | 40 mm |
| Pile density (warp direction); | 40 pile units/inch |
| Pile density (weft direction); | 40 pile units/inch |
| Warp yarn density of each ground construction; | 80 ends/inch |
| Weft yarn density of each ground construction; | 60 ends/inch |
| Pile yarn fixing construction; | fast pile system |

The double velvet fabric was then subjected to hot water treatment to remove the PVA staple fibers, thereby loosening the interlace by the twists of component fibers of the connecting pile.

This loosening action enabled this double velvet fabric to be easily separated into two pile fabrics by applying a separating force to the ground constructions to slide-separate the PBT staple fibers without cutting. The pile fabric thus obtained had the following construction. The length of the component pile fibers in each pile varies with a suitable distribution, which is preferable in an artificial fur, as shown in FIG. 11A.

We claim:

1. In a method of manufacturing artificial fur, the steps which comprise:

(a) forming a pair of spaced-apart ground constructions and a connecting pile comprising a plurality of staple pile fibers comprising a first group of fibrous materials of a denier and length sufficient to form the guard hairs of said artificial fur, having tapered ends, and a second group of fibrous materials of a denier and length to form the underfur of said artificial fur, said pile fibers extending in yarn-like form across the intervening space between said ground constructions, said fibers being maintained in continuity by a binder material, some of the fibers being attached to one but not the other of said ground constructions and others of the fibers being attached to the other but not the one of said ground constructions, (b) breaking the continuity of said pile fibers by liberating said fibers from said binder material, and (c) causing longitudinal sliding separation of said liberated fibers between said spaced-apart ground constructions, such that at least some of the said fibers are longitudinally slidingly separated but not broken.

2. A method according to claim 1, wherein said ground constructions are woven fabrics.

3. A method according to claim 1, wherein said ground constructions are knitted fabrics.

4. A method according to claim 1, wherein said ground constructions comprise a double velvet weave fabric.

5. A method according to claim 1, wherein said ground constructions comprise a double pile knitted fabric.

6. A method according to claim 1, wherein said liberating step comprises severing said binder material which is in the form of a weak yarn disposed around the pile fibers, and the step of breaking the continuity of said pile fibers is carried out by imparting tension along the fiber axes.

7. A method according to claim 1, wherein said liberating step comprises dissolving said binder material which is in the form of a soluble yarn disposed around the pile fibers, and the step of breaking the continuity of said pile fibers is carried out by separating said two ground constructions so that tension is applied along the axes of the connecting pile fibers.

8. A method according to claim 1, wherein said step of breaking the continuity of said pile fibers is carried out by imparting a force to each connecting pile in a direction across the axis thereof.

9. A method according to claim 8 wherein said continuity breaking step is a cutting step applied to cut said binder material while leaving pile fibers uncut.

10. A method according to claim 1, wherein the length of said yarn-like form being not shorter than the average length of said first group of fibrous material.

11. A method according to claim 10, wherein the fibers of said first group of fibrous material are longer than the fibers of said second group of fibrous material.

12. A method according to claim 10, wherein the length of fibers of the second group of fibrous material is not less than the length of fibers of the first group of fibrous material.

13. A method according to claim 10, wherein said second group of fibrous material is provided with crimp.

14. A method according to claim 10, wherein said second group of fibrous material is a multi-filament yarn.

15. A method according to claim 10, wherein fibers of said first group are provided with two tapered free ends and said two groups of fibrous materials satisfy the following relationship:

the fineness (D) of said first group of fibrous material is in teh following range defined by the $$15 \leqq D \leqq 80 \qquad \text{Equation (1)}$$

the blending ratio (R) of said two groups of fibrous materials is in the following range defined by the $$[50D/50 + D \leqq] \leqq R \leqq (450/D) + 55 \qquad \text{Equation (2)}$$

wherein

D designates the denier of the thickest portion of each fibrous material of said first group, R designates the blend ratio of said fibrous material of said first group in % by weight and is defined by the equation $$R = [A/A + B] \times 100,$$

where

A designates the weight of said first group of fibrous material contained in a unit weight of said pile yarn, and B designates the weight of said second group of fibrous material contained in said unit weight of said pile yarn.

16. A method according to claim 10, wherein the length of the fibers of said first group of fibrous material is in the range between 10 and 75 mm.

17. A method according to claim 10, wherein the length of the fibers of the first group of fibrous material is in the range between 15 and 30 mm.

18. A method according to claim 10, wherein the ratio between the length of the fibers of said first group of fibrous material and the length of the fibers of said second group of fibrous material is greater than 1 and smaller than 5.

19. A method according to claim 10, wherein the blend ratio of said first group of fibrous material in said pile fibers is in a range between 15% and 70%.

20. A method according to claim 10, wherein at least one of the fibers of said first and second groups of fibrous material is a splitable fiber.

21. A method according to claim 10, wherein at least one of said groups of fibrous material is a spun yarn.

22. A method according to claim 10, wherein at least one of said groups of fibrous material is a filament yarn.

23. A method according to claim 10, wherein at least one of said groups of fibrous material is a multi-filament yarn.

24. A method according to claim 10, wherein said binder material includes a third group of fibrous material in addition to said first and second group of fibrous materials.

25. A method according to claim 24, wherein said third group of fibrous materials comprises multi-filament yarns.

26. A method according to claim 25, wherein said third group of fibrous material is soluble.

27. A method according to claim 24, wherein the length of said first group of fibrous material is greater than that of the second group of fibrous material.

28. A method according to claim 24, wherein the length of said second group of fibrous material and the length of said third group of fibrous material are greater than the length of the first group of fibrous material.

29. A method according to claim 24, wherein said third group of fibrous material has such limited strength that it is easily broken by a force less than the force required to break the fibers of said second group of fibrous material.

30. A method according to claim 24, wherein said second group of fibrous material is provided with crimp.

31. A method according to claim 24, wherein said third group of fibrous materials comprises staple fibers.

32. A method according to claim 1, wherein said pile fibers comprise a spun yarn.

33. A method according to claim 32, wherein said spun yarn is made from a blend of said first and second groups of fibrous materials.

34. A method according to claim 32, wherein said pile yarn is a core-spun yarn.

35. A method according to claim 1, wherein said pile fibers comprise a plurality of component yarns, and wherein these component yarns are twisted.

36. A method according to claim 1, wherein said pile fibers comprise a plurality of component yarns plied with each other.

37. A method according to claim 36, wherein at least one of said groups of fibrous material is a spun yarn.

38. A method according to claim 36 wherein at least one of said component yarns of said pile fibers is a multi-filament yarn.

39. A method according to claim 1, wherein a main portion of said fibrous material is yarn having substantially zero to mimimal low twist.

40. A method according to claim 1, wherein said staple pile fibers are provided with a number of fibrous maerials partially fixed to each other by melting.

41. A method according to claim 1, wherein said binder material comprises an auxiliary yarn which sprially surrounds a main portion of said pile yarn.

42. A method according to claim 41, wherein said auxiliary yarn is formed of a fibrous material having greater solubility than the fibrous materials of said first and second groups of fibrous materials.

43. A method according to claim 1, wherein said continuity breaking operation is carried out such that at least some of the fibers of said second group of fibrous material are broken but some of the fibers of said first group of fibrous material are subjected to said sliding separation.

44. A method according to claim 1, wherein said fibrous material comprises a yarn provided with fibers so arranged therein that the free ends of the individual fibers are distributed at random therein.

45. A method according to claim 1, wherein a backing is applied to the back surface of a ground construction.

46. A method according to claim 1, wherein a raising treatment is further applied to the resulting pile fabric.

47. A method according to claim 1, further comprising dyeing and finishing the resulting pile fabric.

48. A method according to claim 1, wherein a brushing treatment is further applied to the resulting pile fabric.

* * * * *

UNITED STATES PATENT AND TRADEMARK OFFICE

CERTIFICATE OF CORRECTION

PATENT NO. : 4,773,135

DATED : Sept. 27, 1988

INVENTOR(S) : Kenji Sato; Seiichi Yamagata; Masaaki Sakai

It is certified that error appears in the above-identified patent and that said Letters Patent is hereby corrected as shown below:

Name of third inventor misspelled. It reads Masaski Sakai and it should read --Masaaki Sakai--.

Signed and Sealed this

Fifteenth Day of August, 1989

*Attest:*

*Attesting Officer*

DONALD J. QUIGG

*Commissioner of Patents and Trademarks*